US006354570B1

(12) United States Patent
Christensen et al.

(10) Patent No.: US 6,354,570 B1
(45) Date of Patent: Mar. 12, 2002

(54) LIFTING DEVICE AND METHOD

(75) Inventors: Jimmie Christensen; Barbara Christensen, both of So. Jordan, UT (US)

(73) Assignee: White Glove Cleaning, Inc., South Jordan, UT (US)

( * ) Notice: Subject to any disclaimer, the term of this patent is extended or adjusted under 35 U.S.C. 154(b) by 0 days.

(21) Appl. No.: 09/687,970

(22) Filed: Oct. 12, 2000

(51) Int. Cl.[7] ..... B66F 3/00
(52) U.S. Cl. ..... 254/131
(58) Field of Search ..... 254/131, 132, 254/8 B, 133 R, 120–122; 269/17

(56) References Cited

U.S. PATENT DOCUMENTS

| | | | | | |
|---|---|---|---|---|---|
| 2,420,001 | A | * | 5/1947 | McCollum | 254/131 |
| 3,467,405 | A | * | 9/1969 | Fogg | 254/131 |
| 4,250,769 | A | | 2/1981 | Herring | |
| 4,302,023 | A | | 11/1981 | Kiesz | |
| 4,662,607 | A | * | 5/1987 | Mochizuki et al. | 254/131 |
| 4,776,603 | A | | 10/1988 | Watts | |
| 4,846,443 | A | | 7/1989 | Collins et al. | |
| 5,234,197 | A | | 8/1993 | Wurdack | |
| 5,299,779 | A | | 4/1994 | Collins | |
| 5,382,131 | A | * | 1/1995 | Werthmann | 254/131 |
| 5,385,335 | A | | 1/1995 | Wurdack | |
| 5,459,897 | A | | 10/1995 | Wurdack | |
| 5,529,287 | A | | 6/1996 | Pelosi, Jr. et al. | |
| 5,678,804 | A | * | 10/1997 | Lintelman et al. | 254/131 |
| 5,713,557 | A | * | 2/1998 | Kang | 254/9 B |
| 5,755,429 | A | | 5/1998 | Pelosi, Jr. et al. | |
| 5,848,668 | A | | 12/1998 | Kafrissen et al. | |
| 5,971,360 | A | * | 10/1999 | Sinsley | 254/8 B |
| 6,113,044 | A | | 9/2000 | Stratman | |

* cited by examiner

*Primary Examiner*—Joseph J. Hail, III
*Assistant Examiner*—Lee D Wilson
(74) *Attorney, Agent, or Firm*—Thorpe North & Western, LLP

(57) ABSTRACT

The present invention provides a device and method for lifting. The device has a handle member configured to be grasped by a user, joined to a lifting arm which is configured to engage an object to be lifted. The handle member and the lifting arm are rigidly connected at a vertex and form an obtuse angle therebetween. Further, the device has at least one wheel coupled thereto near the vertex, which allows forward and backward displacement of the device during the raising and lowering an object.

12 Claims, 4 Drawing Sheets

LIFTING DEVICE AND METHOD

THE FIELD OF THE INVENTION

The present invention relates generally to a lifting device. More particularly, it concerns a device for lifting an object which is configured to maintain the horizontal integrity of at least a portion of the lifted object.

BACKGROUND OF THE INVENTION

Often situations arise where an object, such as a piece of furniture, must be lifted in order to retrieve an article which is underneath the object, or to place an article, such as a support, underneath the object. The act of lifting an object of significant size and weight is difficult and may pose a risk of injury. Further, the task of simultaneously lifting the object and retrieving an article, or placing an article under the object in a specific location, is especially inconvenient and difficult for a single person to perform.

Additional situations may arise where an object must be raised to a certain height and then fixed to a second object while suspended. For example, to install a tire on an automobile, the tire must be lifted and affixed to a wheel base. Such a task requires the simultaneous effort of lifting, aligning, and affixing, which can often be inconvenient and difficult for one person to perform alone.

Situations of these types occur regularly in certain industries. For example in the cleaning industry, and more particularly, in the carpet cleaning industry, a technician is required to lift furniture to place one or more support articles, such as skidders, blocks, or tabs, underneath the furniture prior to cleaning. Once the skidders are in place, the furniture may be moved with ease, and with little risk of damage or wear to the carpet. Alternatively, support blocks may allow cleaning under the furniture without moving it from the area to be cleaned, due to the increased height between the bottom of the furniture and the floor.

In the industry of automotive repair, a mechanic often finds himself changing, or rotating the tires of an automobile for a customer. In this case, the side of the car on which the designated tire is located may be raised using a jack, and the tire removed. Once the repaired or new tire is ready, it must be properly aligned with the lugs, and then affixed to the wheel base. As the side of the car is raised, the tire must be simultaneously lifted, aligned with the lugs, and affixed to the wheel base. The performance of such tasks simultaneously is inconvenient and difficult.

When placing an article under a lifted object, it may be desired or necessary that a certain portion of the object come to rest upon the article. For example, when placing skidders under a sofa with legs, it is necessary that the legs come to rest upon the skidders. Therefore, each skidder must be placed with precision in a spot on the floor where it can be predicted with confidence that the leg will come to rest when the sofa is lowered. In order to increase the convenience and accuracy of making such a prediction, the integrity of the horizontal positioning of at least a portion of the sofa must be maintained. Otherwise, if the entire sofa travels horizontally while it is being lifted, the location where the lifted portion will come to rest when it is lowered will be difficult to estimate.

Prevention of horizontal traveling of an object due to lifting may also be desired in certain circumstances in order to prevent damage or wear on the object itself, or the floor on which it rests. For example, a dining room table which is allowed to scrape horizontally for any distance across a finished wood floor may cause marring or scratching to the floor. Further, the dragging of an appliance, such as a washing machine may cause damage to the floor and the appliance. In such a case, it would be desirable, if not imperative, to lift the object and place or retrieve an article thereunder without causing any horizontal movement of the unlifted portion.

SUMMARY OF THE INVENTION

It has been recognized that it would be advantageous to develop a lifting device which facilitates the lifting and lowering of an object of substantial size and weight. In addition, it has been recognized that it would be advantageous to develop a lifting device which can be operated with one hand, allowing a user to simultaneously perform a second function in addition to the lifting. In addition, it has been recognized that it would be advantageous to develop a lifting device which allows an object to be lifted while maintaining the integrity of the horizontal position of at least a part of the object. In addition, it has been recognized that it would be advantageous to develop a lifting device which allows the lowering of a raised object into the same original horizontal position is desirable.

Accordingly, the present invention provides a lifting device having an elongated handle member configured to be grasped by a user, and a lifting arm coupled to the handle, and configured to engage an object. The handle member and the lifting arm are coupled at a vertex and advantageously form an obtuse angle therebetween. Further, at least one wheel is coupled to the device, near or at the vertex.

In one aspect, the elongated handle member and the lifting arm may be single integral elongated shaft. In another aspect, the handle member and the lifting arm may be rigidly connected making the angle formed therebetween a fixed angle.

In one aspect, the at least one wheel may be a pair of wheels coupled on opposite sides of the device. In another aspect, the at least one wheel may be fixed to the lifting arm. In a further aspect, the at least one wheel may be fixed to the vertex. In yet another aspect, the vertex advantageously can have an elevation of between approximately 1 and 6 inches above the ground.

In one aspect, the lifting device advantageously has a working position height of less than approximately 3 feet, and a length of less than approximately 4 feet. In yet another aspect, the working position height of the lifting device may be less than approximately 2 feet, and the length less than approximately 3 feet.

In one aspect, the lifting device may include an engagement plate, coupled to the lifting arm, configured to engage an object to be lifted. In a further aspect, the engagement plate may be a flat plate. In another aspect, the engagement plate may have a plurality of planar surfaces forming an obtuse angle therebetween. In yet another aspect, the planar surfaces of the engagement plate may form an acute angle therebetween. In a further aspect, the planar surfaces of the engagement plate may form a right angle therebetween. In another aspect, the device may further include an extension arm configured to detachably engage a distal end of the lifting arm. The extension arm may terminate in an engagement plate for engaging a portion of an object, which is located more than approximately 1 foot above the floor. Such an engagement plate may be of any of the above-recited configurations for the engagement plate at the distal end of the lifting arm.

In one aspect, the lifting device may be configured to pivot between: 1) a first orientation in which the lifting arm is at a first lower elevation and the handle member is at a first higher elevation and forms an acute angle with the ground, and a 2) second orientation in which the lifting arm is at a second higher elevation and forms an acute angle with the ground and the handle member is at a second lower elevation.

The present invention also encompasses a method of lifting an object using the lifting device. Such a method includes providing a lifting device as disclosed herein, engaging a portion of an object with the lifting arm of the device, applying a downward force on the handle member of the device, to lower the handle member and raise the lifting arm, thus lifting the portion of the object, and simultaneously horizontally displacing the lifting device to arrest horizontal displacement of the entire object, and maintain the horizontal position of at least a portion of the object.

In one aspect, only a portion of the object may be lifted, and another portion of the object may not be lifted. In such a case, the object pivots about a horizontal axis created by the unlifted portion of the object. In another aspect, the entire object may be lifted.

In one aspect, the downward force applied to the handle member may be applied to the handle with a single hand. In a further aspect, the method further includes simultaneously performing a second function near a distal end of the lifting arm with a second hand. In one aspect, the second function may be placing a support under the lifted portion of the object at a place on the ground which was in contact with the object. In yet another aspect, the method may further include lowering the object to rest upon the support.

In one aspect, the method of the present invention may also include the steps of removing the force applied to the handle member to lower the lifting arm and simultaneously horizontally displacing the lifting device, in a direction opposite to an original direction of displacement, in order to arrest horizontal relocation of the object and return the object to its original horizontal position. In another aspect, the method of the present invention may also include the steps of vertically aligning the lifted object with an elevated point to which the object is to be affixed, affixing the lifted to the point, and removing the lifting device from under the lifted object.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1:
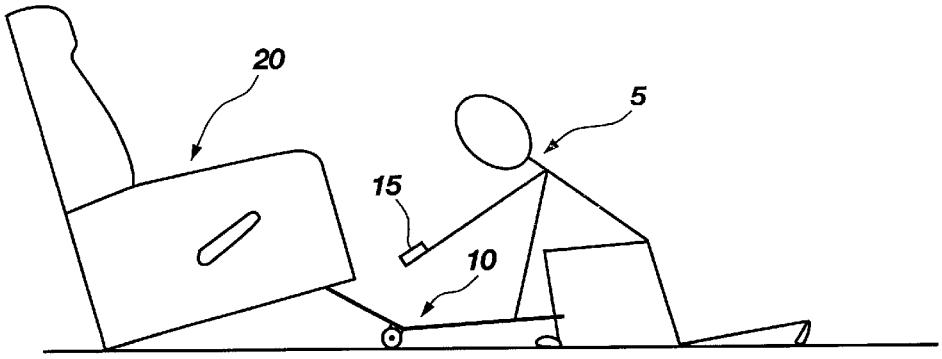
FIG. 1 is a side view of a user employing a lifting device in accordance with the present invention to lift an object and place an article beneath the object.

Before the present lifting device is disclosed and described, it is to be understood that this invention is not limited to the particular design and materials disclosed herein, but is extended to equivalents thereof as would be recognized by those ordinarily skilled in the relevant arts. It should also be understood that terminology employed herein is used for the purpose of describing particular embodiments only, and is not intended to be limiting.

It must be noted that, as used in this specification and the appended claims, the singular forms "a," and, "the" include plural referents unless the context clearly dictates otherwise. Thus, for example, reference to an engagement plate containing "an angle" includes one or more angles, reference to "an obtuse angle" includes reference to one or more specific obtuse angles, and reference to "a length" includes reference to one or more lengths.

In describing and claiming the present invention, the following terminology will be used in accordance with the definitions set forth below.

As used herein, "vertex" refers to the point at which two lines intersect to form an angle.

As used herein, "obtuse" refers to an angle which is greater than 90° and less than 180°.

As used herein, "acute" refers to an angle which is greater than 0° and less than 90°.

As used herein, "right angle" refers to an angle which is approximately 90°.

As used herein, "ground" and "floor" may be used synonymously, and refer to a surface upon which the lifting device rests when being employed to lift an object.

As used herein, "working position" refers to one or more horizontal and vertical orientations in which the lifting device exists, or through which it passes, while performing the act of lifting or lowering an object. Therefore, by way of example without limitation, one working position may include an orientation where the lifting arm is substantially parallel to the ground or floor, and the handle member forms an acute angle with the ground or floor.

As use herein, "working position height" refers to the distance between the ground or floor on which the lifting device rests, and the highest vertical point on the lifting device, when the lifting device is placed in a working position.

As used herein, "working position length" refers to the distance along the ground or floor, upon which the device rests, which extends from the distal end of the lifting arm, to the proximal end of the handle member.

Height, length, and other dimensions, or numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

For example, a length of approximately less than 4 feet should be interpreted to include not only the explicitly recited length of 4 feet, but also to include individual lengths within that range, such as 3 feet, 2.5 feet, 1 foot, etc. This interpretation should apply regardless of the breadth of the range or the characteristic being described.

Figure 2:
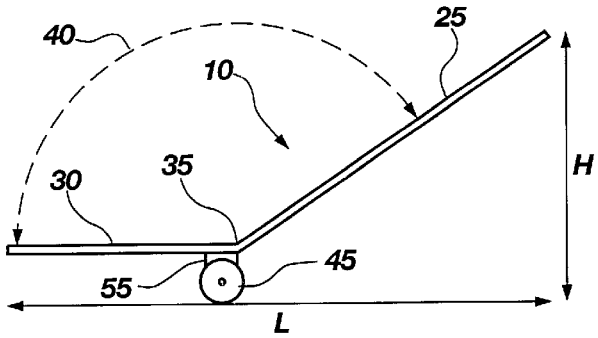
FIG. 2 is a side view of one embodiment of a lifting device in accordance with the present invention.
Figure 3:
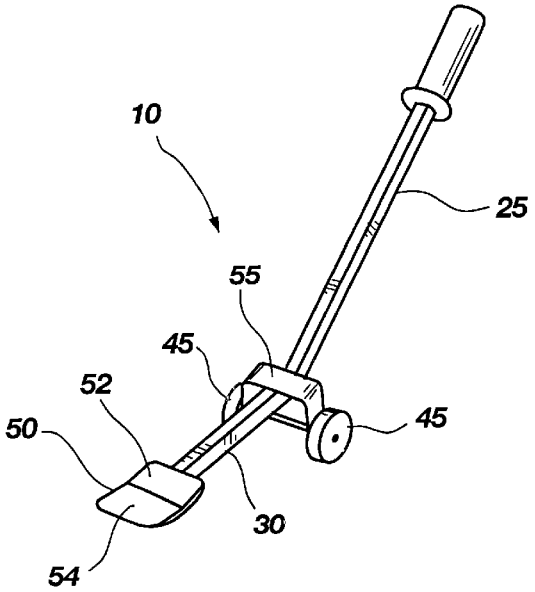
FIG. 3 is a perspective view of one embodiment of a lifting device in accordance with the present invention.

Referring now to FIG. 1, is shown a side view of a user 5, engaged in one aspect of the general method of the present invention by operating lifting device 10 with one hand to lift object 20, and simultaneously placing a support article 15, under lifted object 20 using a second hand. FIGS. 2 and 3 present two of the possible embodiments of the lifting device being used by user 5.

Referring now to FIG. 2, is shown the lifting device 10 in accordance with one embodiment of the present invention. Lifting device 10, generally includes an elongated handle member 25, which is configured to be grasped by a user, and a lifting arm 30, which is configured to engage an object. Handle member 25 and lifting arm 30 are coupled at a vertex 35, and form an obtuse angle 40 therebetween. Further, at least one wheel 45 is coupled to lifting device 10, at or near vertex 35.

The handle member 25 and lifting arm 30 may take the form of any one of a wide variety of suitable structures conceivable by one skilled in the art. As shown in FIG. 3, handle member 25 and lifting arm 30 may be a single integral elongated shaft. Such a shaft may be solid or hollow. While this shaft is depicted with a square shape in FIG. 3, the shape and size of handle member 25 and lifting arm 30 may be of a wide range of shapes and dimensions, such as circular, oval, triangular, hexagonal, etc. Further, handle member 25 and lifting arm 30 are not limited to a single shaft design, but may include without limitation a plurality of shafts, for example, two or more parallel shafts for handle member 25, and two or more shafts for lifting arm 30. Further, handle member 25 and lifting arm 30 are not limited in design to shafts, but may be of other designs, such as wide plates, etc.

Referring again to FIG. 2, is shown lifting device 10 in a working position with length L, and height H indicated. In one aspect of the invention, the length L, may be less than approximately 4 feet, and height H may be less than approximately 3 feet. In another aspect of the invention, length L may be less than approximately 3 feet, and height H may be less than approximately 2 feet.

As depicted in FIG. 3, lifting device 10 has engagement plate 50 coupled to lifting arm 30 at a distal end thereof. While engagement plate 50 as depicted in FIG. 3, is configured with a plurality of planar surfaces 52 and 54 which form an obtuse angle therebetween, one of ordinary skill in the art will readily recognize that other configurations of engagement plate may be employed depending on the specific use and result intended.

For example, engagement plate 50 may extend from the vertex of device 10 forward along the entire length of the lifting arm 30. Alternatively, lifting arm 30 may take the form of one large engagement plate. Other configurations such as a flat surface, planar surfaces forming an acute angle, planar surfaces forming a right angle, and ridged, or teeth configurations may be used when appropriate for the engaging a specific object to be lifted. Further, the engagement surface of the engagement plate may be padded by a soft material to protect certain objects from damage by the engagement plate. Examples of specific substances will be readily recognized by those skilled in the art and include without limitation: rubber, foam, cloth, and soft plastics. By way of further example without limitation, when using lifting device 10 to lift and mount a tire on a vehicle, an engagement plate with a plurality of projections, or teeth may be desired in order to increase the grip of the device on the tire during lifting. An increase in the grip of the device provides increased stability of the object during the lifting process.

Engagement plate 50 may be permanently affixed to the distal end of lifting arm 30, or may be detachable, so that a variety of different shaped plates may be used with a single lifting device for a variety of purposes. Mechanisms for attaching and detaching engagement plates will be readily recognizable to those skilled in the art, and include, but are not limited to: friction fit mechanisms, hole and button or pin mechanisms, magnetic mechanisms, screw on mechanisms, clamping mechanisms, etc. In one aspect, the lifting arm may be hollow, and the engagement plate may be formed with a stem which is sized to fit into the hollow portion of the lifting arm, and be secured by any of the above-recited mechanisms. In another aspect, the stem of the engagement plate may be sized larger than the outer surface of lifting arm 30, and engage it accordingly using any of the mechanisms recited above.

Figure 7:
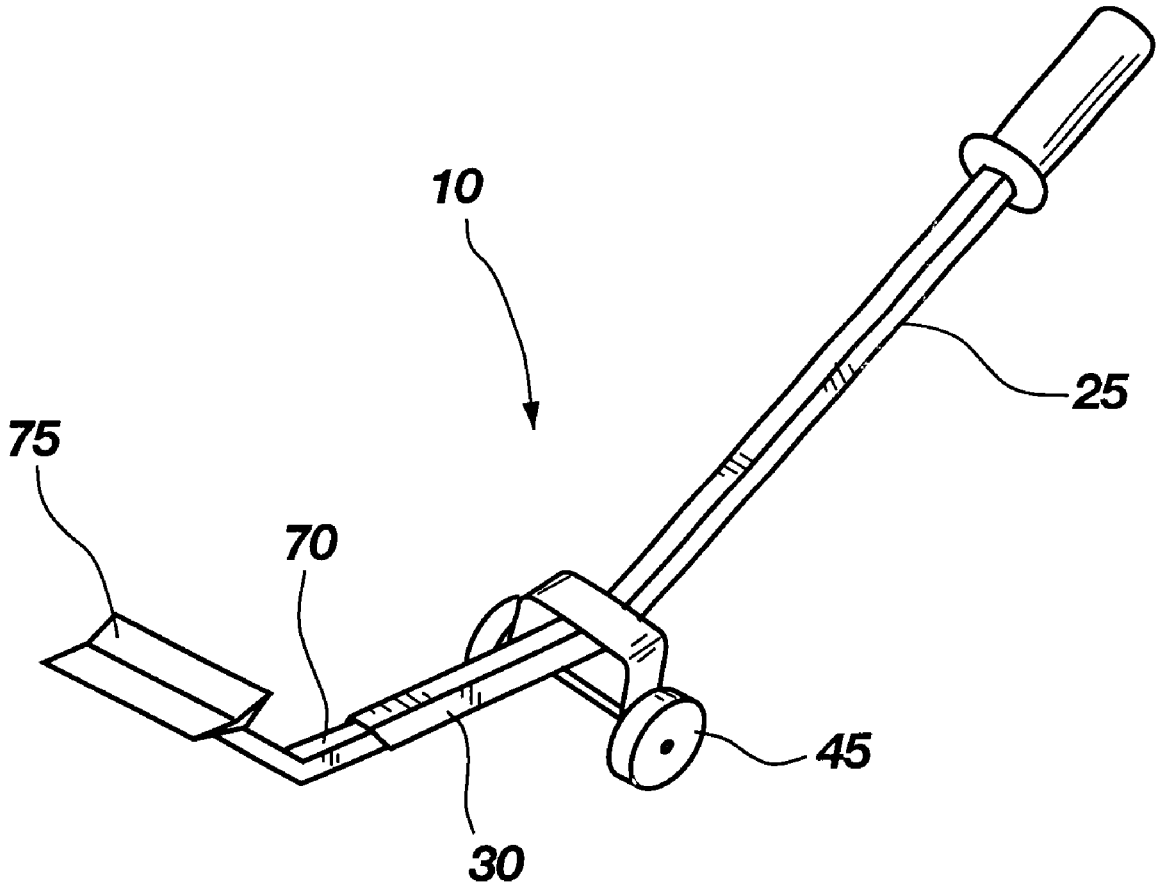
FIG. 7 is a perspective view of another embodiment of a lifting device in accordance with the present invention.

FIG. 7 illustrates one embodiment of an extension arm 70 which can be coupled to the lifting arm 30 in order to engage an object at an area which is more than about 1 foot off of the floor. As illustrated, when lifting arm 30 is a hollow shaft, extension arm 70 may have an outer shape and diameter which is configured to be coupled with lifting arm 30 using a friction fit with the hollow portion of the shaft. However, other possible mechanisms for attachment will be recognized by one skilled in the art, such as those recited above with respect to attaching the stem of an engagement plate 50. In one aspect, extension arm 70 may be coupled to lifting arm 30 simultaneously with engagement plate 50. In another aspect, engagement plate 50 may be removed before attachment of extension arm 70 to lifting arm 30.

In addition to attaching to the lifting arm 30, extension arm 70 may be attached to engagement plate 50 (not shown) Those ordinarily skilled in the are will readily recognized the mechanisms by which such an attachment may be performed, and all are considered to be within the scope of the present invention. By way of example without limitation, clamping, friction fitting, tongue in groove mechanisms, and slot mechanisms may be employed.

Extension arm 70 may take any shape or form required in order to achieve a desired result, or be of desired use. In one aspect, extension arm 70 may be a straight arm. In another aspect, extension arm 70 may be angled at one or more obtuse angles, as shown. In yet another aspect, extension arm 70 may be angled at a right angle. In a further aspect, extension arm 70 may be angled at one or more acute angles.

Coupled to the distal end of extension arm 70 is engagement plate 75. Engagement plate 75 serves the same purpose as engagement plate 50 described above, and may take any desired configuration required to achieve a specific result, or perform a specific function. All of the above discussion with respect to plate configuration is applicable to engagement plate 75.

In one aspect, extension arm 70 may be permanently attached to, and integrally formed with lifting arm 30. In essence, lifting arm 30 may be permanently configured to have the length, shape, dimensions, etc., of lifting arm 30 plus extension arm 70 as described herein.

Referring again to FIG. 3, is shown an embodiment of device 10, wherein at least one wheel 45 is a pair of wheels coupled on opposite sides of the device. One advantage provided by a pair of wheels is that it is not necessary to balance the lifting device 10 from side to side while using it. Other structures, such as a single elongated roller, which provide the same advantage will be recognized by those skilled in the art and can also be employed with the present invention.

The at least one wheel 45 in FIGS. 2 and 3 is shown coupled near the vertex 35. In one aspect, at least one wheel 45 may be coupled near vertex 35 by attachment to lifting arm 30. In another aspect, at least one wheel 45 may be coupled near vertex 35 by attachment at, or to, vertex 35. In yet another aspect, at least one wheel 45 may be coupled near vertex 35 by attachment to handle member 25.

One of ordinary skill in the art will readily recognize the variety of mechanisms by which the at least one wheel 45 may be coupled to lifting device 10. As depicted in FIGS. 2 and 3, bracket 55 may be employed as the coupling mechanism. Bracket 55 may be attached to device 10 by any mechanism apparent to those of ordinary skill in the art, such as welding, screwing, sealing, etc., depending on the type of material from which device 10 is made. In one aspect, device 10 may be made of wood. In another aspect, device 10 may be made of metal. In another aspect, device 10 may be made of a plastic, or other polymeric material. In yet another aspect, device 10 may be made of a composite, or combination of any of the materials recited above. In any case, those of ordinary skill in the art will recognize the rigidity which is required for the effective function of device 10, and will be able to determine the specific parameters of thickness, etc. in order to fabricate a working device out of a given medium.

The angle formed by handle member 25 and lifting arm 30 has vertex 35, and creates obtuse angle 40. Obtuse angle 40 advantageously allows a user to exert a downward force on handle member 25 when lifting an object. The ability to lift an object by exerting only a downward force facilitates operation of device 10 using a single hand, and further allows a user to employ their body weight in order to facilitate lifting.

While the vertex 35 of device 10 may be adjustable, so that a variety of obtuse angles may be assumed, in one aspect of the invention, vertex 35 may be fixed, and thus the obtuse angle 40 formed between handle member 25 and lifting arm 35 may be fixed.

Figure 5:
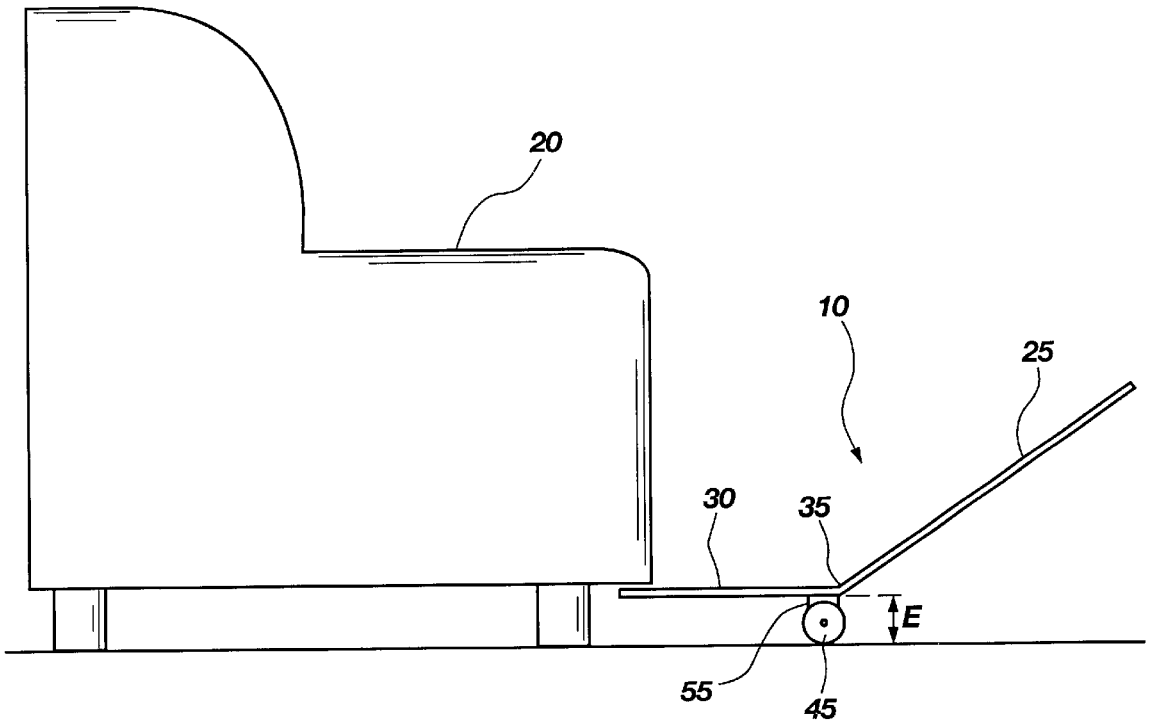
FIG. 5 is a side view of one embodiment of a lifting device in accordance with the present invention in a first working position, engaging an object to be lifted or pivoted.

Referring now to FIG. 5 is shown lifting device 10, engaging an object 20 to be lifted. The elevation of vertex 35 is indicated at E. In one aspect, the elevation of vertex 35 above the floor or ground, upon which device 10 is resting, may be from approximately 0 to approximately 12 inches. In another aspect of the invention, the elevation of the vertex 35 above the floor or ground may be from approximately 1 to approximately 6 inches.

Figure 4A:
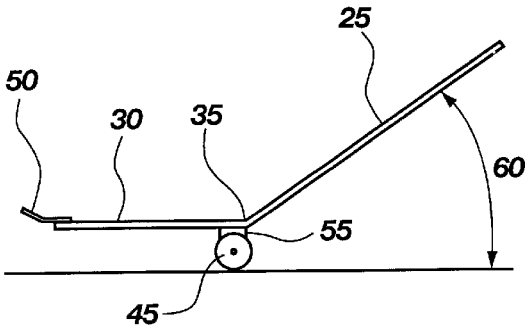
FIG. 4*a* is a side view of one embodiment of a lifting device in accordance with the present invention oriented in a first position, or first working position.
Figure 4B:
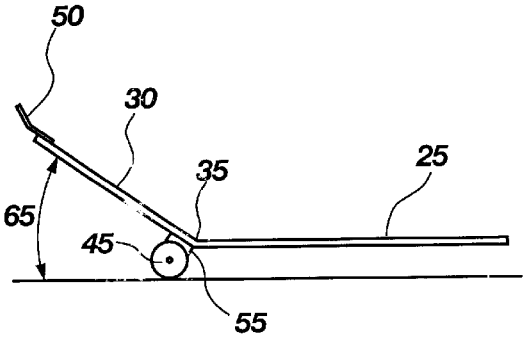
FIG. 4*b* is a side view of one embodiment of a lifting device in accordance with the present invention oriented in a second position, or second working position.

FIGS. 4*a* and 4*b* illustrate different orientations of device 10 when placed in first and second positions. Particularly, FIG. 4*a* illustrates device 10 in a first orientation, or first working position with lifting arm 30 in a first lower elevation and handle member 25 in a first higher elevation. Of note is that while in this first higher elevation, handle member 25 forms acute angle 60 with the floor or ground. In addition, the lifting arm 30 can be oriented parallel with the ground in the first orientation. In addition, one of the planar surfaces 52 of the plate 50 is oriented generally parallel with the ground to better engage a surface of the object 20 which is elevated from the floor. Alternatively, another planar surface 54 of the plate 50 can be oriented parallel with, and abutting the floor, to better engage a surface of the object 20 resting on the floor.

FIG. 4*b* shows a second orientation or second working position which results from the rotation or pivoting of the vertex 35 during use of device 10. Particularly, lifting arm 30 is at a second higher elevation, and handle member 25 is at a second lower elevation. Of note is that while in this second higher elevation, lifting arm 30 forms an acute angle 65 with the floor or ground.

In operation, a variety of specific acute angles 60 and 65 of varying degree will be formed and passed through as device 10 is pivoted from the first orientation of FIG. 4*a* to the second orientation of FIG. 4*b* and back. All such angles are considered to be within the scope of the present invention.

A method of lifting an object is included in the present invention. Such a method generally includes providing a lifting device as described herein, engaging a portion of the object to be lifted with the lifting of the device, applying a downward force on the handle member of the device to lower the handle member and raise the lifting arm, thus lifting the portion of the object, and simultaneously horizontally displacing the lifting device to arrest horizontal displacement of the entire object and maintain the horizontal position of at least a portion of the object.

Figure 6A:
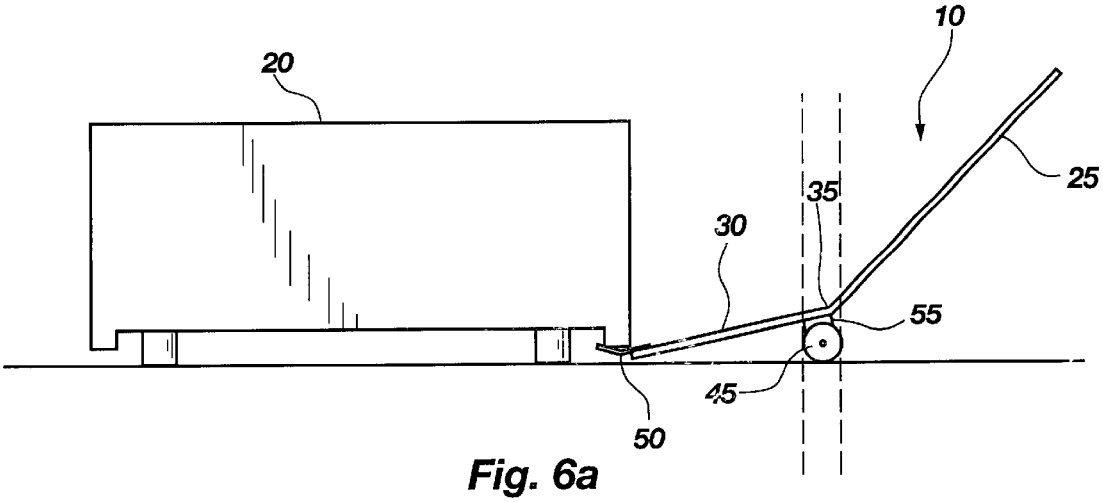
FIG. 6*a* is a side view of one embodiment of a lifting device in accordance with the present invention in a first working position, engaging an object to be lifted.
Figure 6B:
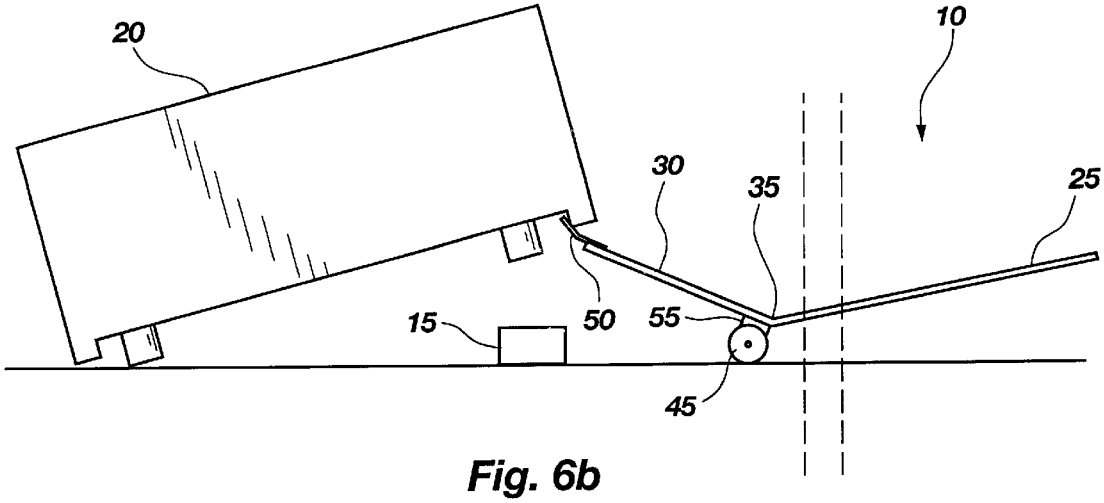
FIG. 6*b* is a side view of one embodiment of a lifting device in accordance with the present invention in a second working position, lifting an object, with a support article placed beneath the lifted object.
Figure 6C:
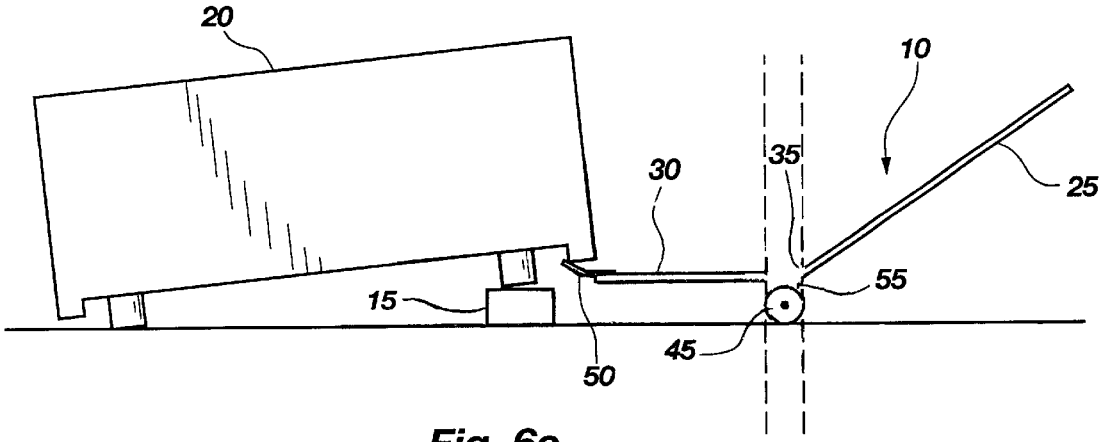
FIG. 6*c* is a side view of one embodiment of a lifting device in accordance with the present invention in a third working position after lowering the object onto the support article.

Referring now to FIGS. 6*a–c*, is shown side views of various significant points of the present method. FIG. 6*a* shows device 10 engaging a portion of object 20 with engagement plate 50. Device 10 is in a first orientation or working position with handle member 25 in a first upper position, and lifting arm 30 in a first lower position in order to engage object 20. Dashed lines are used to represent the horizontal location of vertex 35 and at least one wheel 45.

FIG. 6*b* shows the results which occur when device 10 is pivoted about vertex 35 into a second orientation, or working position. In making such a rotation, or pivot, a downward force is applied to handle member 25. As a result of the downward force, wheel 45 is horizontally displaced. Because wheel 45 is coupled to device 10, the device is displace in a direction toward the object 20 which is being lifted. Such displacement is shown by the position of wheel 45 with respect to the dashed lines representing its original horizontal position.

The displacement of device 10 compensates for and effectively arrests the horizontal movement of at least a portion of object 20. In one aspect when the entire object is not being lifted, but rather only a portion is lifted, the unlifted portion forms a horizontal axis around which the lifted portion pivots. Alternatively, if the entire object were lifted, the displacement of device 10 could arrest the horizontal movement of the entire object.

In connection with lifting object 20, the method of the present invention also advantageously encompasses the operation of device 10 by a user using a single hand, and simultaneously performing a second function with a second hand. In one aspect such a second function may be at the distal end of lifting arm 30, for example, placing an article beneath the lifted object. Articles for placement may depend on the particular object being lifted and results desired. In one aspect, the object being lifted may be a piece of furniture, either for the home, or for the office, and the article may be a support article 15, including but not limited to: skidders, tabs, and blocks. In another aspect, the object being lifted may be an appliance, and the article a support article, hose, wiring, etc.

The placement of a support article 15 is shown in FIG. 6*b*. Because of the arrest of the horizontal movement of object 10, it is possible to accurately predict where the object will come to rest on the floor when lowered. Therefore, a much more accurate estimation of where support article 15 should be place in order to provide the desired support is possible. By way of example without limitation, the position of a portion of an object to be supported may be visibly noted while the portion is still on the ground, and the support article 15 placed on the visibly noted position when the object is raised.

FIG. 6*c* illustrates the positioning of an object 20 which has been lowered to rest up support article 15. In order to lower object 20, the downward force on handle member 25 is removed, and the device is simultaneously horizontally displaced in a direction opposite to the original direction of displacement. FIG. 6*c* illustrates the displacement of at least one wheel 45 back into substantially its original horizontal position. Once again, such displacement allows the object 20 to maintain its horizontal integrity, and come to rest in it original horizontal position. Because of the ability to accurately estimate the placement of article 15, a user is provided with greater assurance that a desire portion of the object will come to rest on article 15, as illustrated.

In an additional aspect, the method of the present invention encompasses employing the lifting device described herein to lift an object, align the object with an elevated point to which the object is to be affixed, and affix the object to the elevated point. Following the affixation of the object, the lifting device is removed from underneath the raised object. One specific example of performing such a task is the task of mounting a tire on a wheel base as recited in the background section. However, those ordinarily skilled in the art will readily recognized that the device may be used for other situation which require similar functions of raising, aligning, and affixing to be performed.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A lifting device comprising:

a) an elongated handle member configured to be grasped by a user;

b) a lifting arm, coupled to the handle member, configured to engage an object;

c) said handle member and said lifting arm being coupled at a vertex and forming an obtuse angle therebetween;

d) at least one wheel, coupled to the device, near the vertex; and e) an engagement plate, coupled to the lifting arm, configured to engage an object to be lifted.

2. A device as set forth in claim 1, wherein said elongated handle member and said lifting arm comprise a single integral elongated shaft.

3. A device as set forth in claim 1, having a working position height of less than approximately 3 feet, and a working position length of less than approximately 4 feet.

4. A device as set forth in claim 1, having a working position height of less than approximately 2 feet, and a working position length of less than approximately 3 feet.

5. A device as set forth in claim 1, wherein the engagement plate has a plurality of planar surfaces forming an obtuse angle therebetween.

6. A device as set forth in claim 1, wherein the at least one wheel is a pair of wheels coupled on opposite sides of the device.

7. A device as set forth in claim 1, wherein the device pivots between 1) a first orientation in which the lifting arm is at a first lower elevation and the handle member is at a first higher elevation and forms an acute angle with the ground, and a 2) second orientation in which the lifting arm is at a second higher elevation and forms an acute angle with the ground and the handle member is at a second lower elevation.

8. A device as set forth in claim 1, wherein the handle member and lifting arm are rigidly connected and the angle formed therebetween is fixed.

9. A device as set forth in claim 1, wherein the at least one wheel is fixed to the lifting arm.

10. A device as set forth in claim 1, wherein the vertex has an elevation of between approximately 1 and 6 inches above the ground.

11. A device as set forth in claim 1, further comprising an extension arm configured to detachably engage a distal end of the lifting arm and form an obtuse angle therewith, said extension arm terminating in an engagement plate configured to engage a portion of an object which is located more than approximately 1 foot above the floor.

12. A lifting device comprising:

a) a single integral shaft of less than approximately 4 feet, having a handle portion at a proximal end, and a lifting portion at a distal end;

b) the handle portion and the lifting portion forming a fixed obtuse angle at a vertex;

c) a pair of wheels, coupled to the lifting portion near the vertex;

d) the vertex being located at an elevation above the ground of between approximately 1–6 inches; and e) an engagement plate, joined at the distal end of the shaft, configured to engage an object to be lifted.

* * * * *